US006804478B2

(12) United States Patent
Martin et al.

(10) Patent No.: US 6,804,478 B2
(45) Date of Patent: Oct. 12, 2004

(54) METHODS AND APPARATUS FOR CONTROLLING A FUSER

(75) Inventors: Michael Joseph Martin, Boise, ID (US); Tim Mitchell Hoberock, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 10/368,533

(22) Filed: Feb. 18, 2003

(65) Prior Publication Data

US 2004/0161254 A1 Aug. 19, 2004

(51) Int. Cl.[7] ..... G03G 15/00
(52) U.S. Cl. ..... 399/45; 399/67
(58) Field of Search ..... 399/45, 66, 67, 399/68, 69, 389, 320, 328; 324/71.1; 219/216

(56) References Cited

U.S. PATENT DOCUMENTS 5,287,144 A 2/1994 Takeda
5,291,253 A 3/1994 Kumasaka et al.
5,608,506 A 3/1997 Omoto
6,111,594 A 8/2000 Jeong
6,243,545 B1 6/2001 Jewell

FOREIGN PATENT DOCUMENTS

JP 58-025677 A * 2/1983
JP 2002-296854 A * 10/2002

* cited by examiner

*Primary Examiner*—Robert Beatty

(57) ABSTRACT

In one non-limiting embodiment an apparatus for controlling a fuser in an imaging apparatus includes a first fuser roller and a second fuser roller in parallel, adjacent orientation and configured to receive sheet media therebetween. The apparatus further includes an electrical voltage source applied across the fuser rollers. The apparatus also includes a voltage difference measuring device configured to measure a difference in the electrical voltage across the first and second fuser rollers when sheet media is received between the first and second fuser rollers, and to generate a voltage difference signal in response thereto. The device includes a controller which is configured to receive the voltage difference signal and to generate a fuser parameter control signal in response thereto. The apparatus also includes a fuser control device responsive to the fuser parameter control signal.

27 Claims, 6 Drawing Sheets

METHODS AND APPARATUS FOR CONTROLLING A FUSER

BACKGROUND

In an electrophotographic imaging process performed by an electrostatic imaging apparatus an imaging substance (typically a dry toner) is transferred (either directly or indirectly) from an optical photoconductor to a sheet of imaging media by an electrostatic process. Examples of electrostatic imaging apparatus include printers, photocopiers, facsimile machines, and "multi-function" imaging apparatus which perform two or more of the afore-mentioned imaging processes. Such imaging apparatus are commonly known as "laser printers", since an electrostatic image is formed on the optical photoconductor through the use of a selectively pulsed laser. Imaging media used in such electrostatic imaging apparatus can include, for example, sheets of paper, transparencies, envelopes, and card stock. After the imaging substance has been transferred to the imaging media the imaging substance is fixed to the imaging media by a fusing process, which typically includes passing the imaging media between two rollers which are part of a fuser. The fusing rollers apply heat and/or pressure to the imaging media to fix the imaging substance to the imaging media.

The fuser typically includes two parallel, adjacent, fuser rollers, though which the imaging media is passed during the fusing process. Parameters which affect the fusing process include the pressure between the fuser rollers (which is subsequently applied to the imaging media), the heat input to one or both of the fuser rollers, and the rate at which the imaging media is passed through the fuser rollers. Ideally, these parameters are selected to optimize the fusing process. Optimization of the fusing process includes providing sufficient energy to fuse the imaging substance to the imaging media without deteriorating the quality of the formed image or deleteriously affecting the quality of the imaging media. For example, if insufficient heat and/or pressure is applied during the fusing process, then the imaging substance can have a tendency to afterwards separate from the imaging media. Further, if excessive heat and/or pressure is applied during the fusing process, then the imaging media can exhibit excessive curling, and/or the imaging substance will "run" (i.e., spread beyond the intended locations of application) on the imaging media.

The results of the fusing process can be affected by the types and/or conditions of the imaging media. More specifically, at least the thickness, the width, the moisture content, and the material of construction of imaging media can affect the results of the fusing process. For example, if a given fusing process is applied to a first sheet of imaging media having a first thickness, and the same process is thereafter applied to a second sheet of imaging media having a second thickness which is different than the first thickness, then the fusing process can be compromised with respect to at least either the first or the second sheet.

Accordingly, it is desirable that a fusing process in an electrophotographic imaging apparatus be adjustable to accommodate variances in the imaging media to be processed by the fusing process. In this way the quality of the resultant image generated on the imaging media can be enhanced. Further, deleterious affects to the imaging media itself can also be reduced.

SUMMARY

In one non-limiting embodiment an apparatus for controlling a fuser in an imaging apparatus includes a first fuser roller and a second fuser roller in parallel, adjacent orientation and configured to receive sheet media therebetween. The apparatus further includes an electrical voltage source applied across the fuser rollers. The apparatus also includes a voltage difference measuring device configured to measure a difference in the electrical voltage across the first and second fuser rollers when sheet media is received between the first and second fuser rollers, and to generate a voltage difference signal in response thereto. The device includes a controller which is configured to receive the voltage difference signal and to generate a fuser parameter control signal in response thereto. The apparatus also includes a fuser control device responsive to the fuser parameter control signal.

In another embodiment a method of determining characteristics of sheet media includes providing first and second electrically conductive rollers in parallel contact, and applying a preselected voltage across the first and second rollers. Sheet media is then placed between the first and second rollers, and the voltage difference across the first and second rollers is measured. The measured voltage difference is then used to determine characteristics of the sheet media.

These and other aspects and embodiments of the present invention will now be described in detail with reference to the accompanying drawings, wherein:

DETAILED DESCRIPTION

Figure 1:
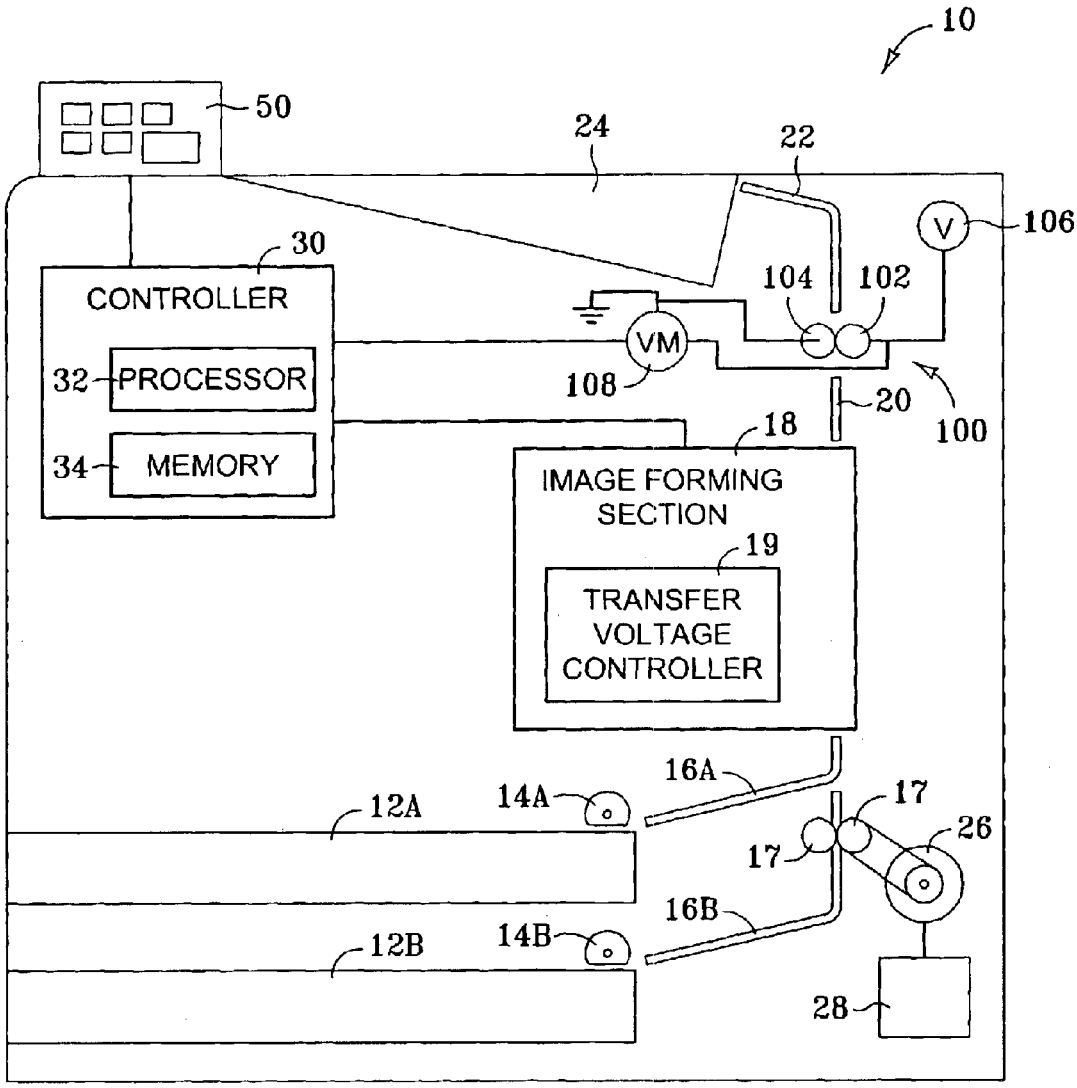
FIG. 1 is a side elevation sectional diagram depicting major components of an imaging apparatus in simplified form, which can incorporate embodiments of the present invention.

Embodiments of the present invention allow a fusing process in an electrophotographic imaging apparatus to be controllable to accommodate variances in the imaging media (sheet media) to be processed by the fusing process. Moreover, embodiments of the invention allow for differences in sheet media to be measured in real-time. In this way the quality of an image generated on the imaging media can be enhanced during an imaging process, and not after an undesirable product has been imaged. In another embodiment, methods and apparatus in accordance with embodiments of the present invention allow for characteristics of sheet media to be determined for purposes beyond a fusing process. As will be described more fully below, embodiments of the invention provide for applying a known voltage across two opposed, in-contact members (such as fuser rollers). A sheet of sheet media is then placed between the two members (as for example, by passing a sheet into a nip formed by two rollers), and the drop in the voltage across the two rollers is then measured. The voltage drop will be indicative of characteristics of the sheet media. For example, when other variables are fixed, then the following results will be produced: for two sheets having different thicknesses, the thicker sheet will produce more voltage drop across the rollers; for two sheets having different moisture contents, the sheet with the higher moisture content will produce more voltage drop across the rollers; for two sheets having different surface textures, the sheet with the rougher surface texture will produce more voltage drop across the rollers; for sheets of transparencies and sheets of paper, in general the transparencies will produce more voltage drop across the rollers than the paper; and for two sheets having different widths, the narrower sheet will produce more voltage drop across the rollers.

Once the voltage difference measurement (generally equivalent to an electrical resistance measurement, but also including other electrical characteristics such as capacitance, etc.) is obtained resulting from the presence of sheet media between the two members, then this information can either be used directly, or in combination with other information, for a variety of purposes. For example, and as will be described more fully below, the voltage difference measurement can be used to control controllable parameters which affect a fusing process. Other examples of uses of the voltage difference measurement include sorting sheets of media, quality control of sheet media, and controlling processes related to the sheet media (such as fusing toner to the sheet media, generating an image onto the sheet media, or cutting the sheet media).

Specific examples of embodiments of the invention will now be described. However, it is understood that the following discussion relates only to examples of specific embodiments, and is not understood to limit the scope of the invention as set forth in the accompanying claims.

Turning now to FIG. 1, a side elevation sectional diagram depicts major components of an imaging apparatus 10 in simplified form, which can incorporate embodiments of the present invention. The imaging apparatus 10 can be, for example, a photocopier, a printer, a facsimile machine, or a so-called "all-in-one" machine which incorporates one of more of the functions of the just-recited examples of imaging apparatus. The imaging apparatus 10 includes one or more sheet media supply trays 12A, 12B, which can contain different types (e.g., different sizes, weights, etc.) of sheet media. The sheet media can be selected automatically via a remote computer (not shown), or through a user interface, such as user interface 50. Pick rollers 14A and 14B are used to selectively move sheet media from the respective media trays 12A, 12B into the respective media feed paths 16A, 16B. Sheet media is moved along the media path by powered rollers (which are exemplarily shown as rollers 17 for media path 16B, but can also be used with other media paths to be further described). The powered rollers can be driven by a motor 26. In one example the motor 26 can be provided with a speed controller 28 to adjust the speed of the rollers 17, and thus the speed at which the sheet media is moved along the media paths. The sheet media is moved past an image forming section 18, which can use an electrophotographic imaging process to apply dry toner or the like to the sheet media to thereby form an image on the sheet media. The processes performed by the image forming section 18 are well known in the art, and need not be described further herein. When the image forming section 18 is an electrophotographic image forming section, then it can further include a transfer voltage controller 19 to control transfer of dry imaging toner to the sheet media, as will be described more fully below. Sheet media exiting the image forming section 18 can be conveyed on media path 20 to a fusing section 100, where dry toner can be fused to the imaging apparatus. The fusing section (or "fuser") 100 includes first and second fuser rollers 102, 104, which can apply heat and/or pressure to the sheet media to fuse toner to the sheet media. Fuser rollers 102 and 104 are in contact with one another and form a nip into which sheet media is received, as will be explained more fully below with respect to FIG. 2. A discharge media path 22 can convey the finished (imaged) sheet media to a discharge tray 24.

The imaging apparatus 10 can further include a controller 30, which can include a processor 32 and a computer readable memory device 34. The computer readable memory device can include RAM and ROM memory components, and can use semiconductor memory chips, as well as other forms of data storage, to perform the memory functions. The controller 30 can be in communication with the user interface 50, as well as the image forming section 18 and the fusing section 100. The controller can thus control the image forming process performed by the image forming section 18, as well as the fusing process performed by the fusing section 100, and can process instructions from the user interface 50 (such as the number of copies to be generated, image density, sheet media selection, etc.). The controller 30 can also be in communication with a remote computer (not shown), which can transmit imaging jobs and specific instructions regarding an imaging job to the controller 30.

As depicted, the fusing section 100 includes a voltage source 106 applied across the first fuser roller 102 and the second fuser roller 104, and a voltage difference measuring device (similar to an ohmmeter) 108 configured to measure a difference in the electrical voltage applied across the first and second fuser rollers. More particularly, the voltage difference measuring device 108 is used to measure the difference in the voltage applied across the first and second fuser rollers 102 and 104 when sheet media is received between the first and second fuser rollers, and to generate a voltage difference signal in response thereto. The voltage difference signal can then be provided to the controller 30. The difference in the voltage applied across the first and second fuser rollers can also be described as the voltage drop across the fuser rollers, and therefore these two expressions will be used interchangeably in the following discussion.

Figure 2:
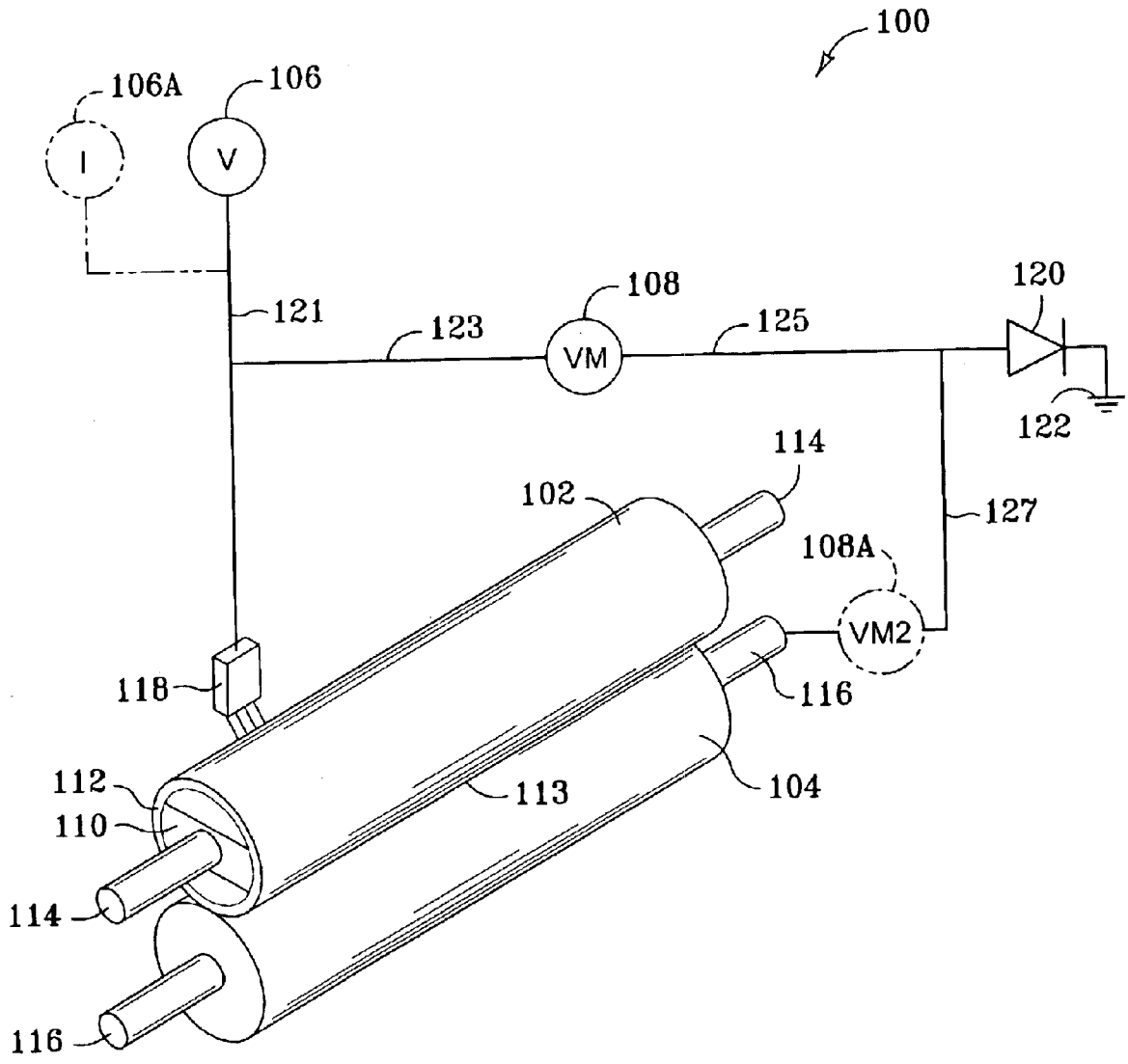
FIG. 2 is an oblique diagram depicting two fuser rollers and electrical circuitry that can be used in accordance with an embodiment of the invention.

FIG. 2 is an oblique diagram depicting the fuser rollers 102 and 104 of FIG. 1, and electrical circuitry that can be used in accordance with an embodiment of the invention. Fuser roller 102 can be supported by shafts 114, and fuser roller 104 can be supported by shafts 116. The fuser rollers 102 and 104 are in parallel, adjacent orientation and configured to receive sheet media therebetween at a nip 113. Typically, the fuser rollers 102 and 104 are configured to be in contact with one another when sheet media is absent between the rollers, but to have sufficient compliance between them to accommodate sheet media of anticipated thicknesses. The compliance can be provided by a compliant surface covering on one or both or the rollers 102, 104, or by mounting the shafts (114 and/or 116) in compliance supports, such as with springs. Fuser roller 102 can include a central core, such as a ceramic strip 110 which incorporates heater elements (not shown), and a fuser film 112 supported over the strip 110 and which rotates about, and in contact with, the strip. As depicted, voltage source 106 is applied to the fuser film 112 of fuser roller 102 by a brush contact 118 via lead 121. The voltage source 106 is grounded from the second roller 104 (at shaft 116) via lead 127. That is, the voltage source 106 is applied across rollers 102 and 104. The components (film 112, roller 104, and shaft 116) are at least partially electrically conductive to allow a voltage to be placed across the rollers 102 and 104. The voltage source 106 can be a biasing voltage which is selected to repel electrostatic toner particles from the fuser film 112. In this case, the voltage source 106 can be configured to provide the biasing voltage as an alternating voltage with a direct current bias. The diode 120 between the ground 122 and the shaft 116 maintains the correct polarity of the biasing voltage to repel electrostatic toner particles from the fuser film 112. Exemplary amplitudes for the biasing voltage can be in the range of about −700 volts to about −500 volts, and in one example a biasing voltage of about 600 volts was used. However, the polarity and magnitude of the voltage will typically be selected in accordance with other system parameters. For example, if the voltage is a biasing voltage, the polarity will be selected based on the type of toner being used (i.e., negative voltage for positively charged toner, and positive voltage for negatively charged toner), and the magnitude will be selected to be sufficient to repel toner particles from the rollers 102, 104. As can be seen, the voltage difference measuring device 108 is placed between the voltage supply source 106 and the shaft 116 of the second roller 104 by leads 123 and 125 to thereby allow a difference in electrical voltage across the first and second fuser rollers 102, 104 to be measured. The voltage difference measuring device 108 is configured to generate a voltage difference signal in response to measuring the voltage difference across the first and second fuser rollers 102 and 104. As will be describe below, the voltage difference signal measured by the voltage difference measuring device 108 is indicative of characteristics of sheet media placed between the fuser rollers 102 and 104.

In an alternative configuration, rather than applying a voltage across the fuser rollers 102 and 104 using voltage supply source 106, a preselected electrical current can be provided (as for example using electrical current supply source 106A, which is shown by phantom lines in FIG. 2) to the first fuser roller 102 and is connected to ground 122 via the shaft 116 of the second fuser roller 104. In this event, the voltage difference measuring device 108 and leads 123 and 125 can be replaced with the electrical current measuring device 108A (shown by phantom lines), which is placed in-line in lead 127 between the second fuser roller 104 and the ground 122. The electrical current measuring device 108A can measure the electrical current flowing in series through the first and second fuser rollers 102 and 104, and particularly when sheet media is disposed between the fuser rollers. By measuring the electrical current flowing from the second fuser roller 104 when sheet media is placed between the rollers 102 and 104, it is possible to determine the characteristics of sheet media between the rollers.

FIGS. 3A through 3D depict oscilloscope waveform traces showing voltage differences measured for sheet media having different characteristics using methods and apparatus in accordance with embodiments of the invention. The waveform traces depicted in FIGS. 3A through 3D can be obtained for example using the apparatus depicted in FIG. 2. In the example shown in FIG. 3A, a reproduction of an oscilloscope trace 210 shows a measurable difference in voltage applied across first and second sheet receiving components (such as fuser rollers 102 and 104 of FIG. 2) which are positioned relative to one another to form a sheet path therebetween. In this example, a biasing voltage of −600 volts was applied between the sheet receiving components, and four sheets of sheet media comprising sheets of paper were sequentially passed between the sheet receiving components. As each sheet of sheet media was passed between the sheet receiving components, a change in voltage signal from a quiescent voltage level "Q" was noted, as indicated by reference numerals 211, 212, 213 and 214. In the example, a voltage difference between the sheet receiving components of 31.75 volts was noted (indicated by the distance between arrows "A" and "B") as each sheet of media passed between the sheet receiving components.

Figure 3A:
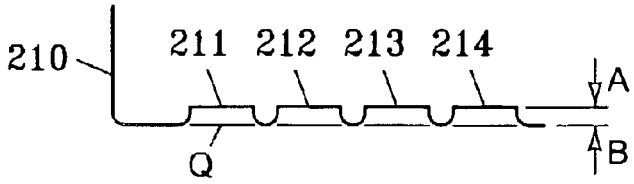
FIGS. 3A through 3D depict oscilloscope waveform traces showing voltage differences measured using methods and apparatus in accordance with embodiments of the invention.
Figure 3B:
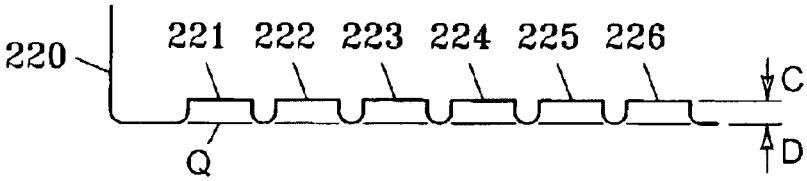

FIG. 3B represents a reproduction of oscilloscope trace 220 showing the effect when six sheets of media were passed between the same sheet receiving components as used in the example of FIG. 3A. In the example shown in FIG. 3B, the same type of paper was used as in the example shown in FIG. 3A, except that the paper used in the second example (FIG. 3B) had a moisture content 2% higher than the paper used in the first example. In the example shown in FIG. 3B, the change in voltage from a quiescent voltage of −600 volts was 69 volts, as indicated by reference numerals 221 through 226 for the six sheets of media. As can be seen, a change in moisture content of the paper of only 2% produced a change in the measured voltage difference of 37.25 volts. The change in the voltage difference for like paper can thus be used to detect a difference in moisture content in the paper. In the case where the sheet receiving components are fuser rollers (such as rollers 102 and 104 of FIG. 2) and dry toner is being fused to the sheets of paper, then the difference in moisture content can affect the fusing process. Accordingly, this change in the voltage differences measured for the sheets of paper having different moisture contents can be used to control the fusing process and thus produce an improved finished product, as will be described more fully below. More over, since the voltage difference is noted as the sheets of media enter the nip of the rollers (e.g., nip 113 between rollers 102 and 104 of FIG. 2), the fusing process can be controlled essentially in real-time.

Figure 3C:
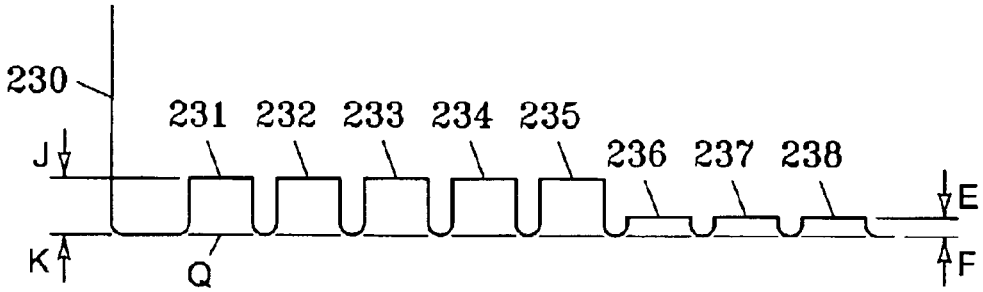

FIG. 3C represents a reproduction of oscilloscope trace 230 showing the effect when eight sheets of media were passed between the same sheet receiving components as used in the examples of FIGS. 3A and 3B. In the example shown in FIG. 3C, the first five sheets of paper (indicated by numerals 231 through 235) were "20 pound" paper, and the last three sheets of paper (indicated by numerals 236 through 238) were "16 pound" paper. (For bond paper, weights in pounds refer to 500 sheets of paper each measuring 22 inches by 17 inches.) As can be seen, a quiescent voltage (in this case, −600 volts, represented by "Q") was applied across the sheet receiving components, and the first sheet of 20 pound paper (indicated by reference numeral 231) was passed between, and in contact with, the two sheet receiving components. A voltage difference, indicated by the distance between arrows "J" and "K" was measured for the first sheet. Four subsequent, essentially identical sheets were then passed through the two sheet receiving components, and the same voltage difference, indicated by the arrows "J" and "K", is measured. However, when the first sheet of 16 pound paper passed between the sheet receiving components (indicated by reference numeral 236), a, different, lesser voltage difference (indicated by the distance between arrows "E" and "F") was measured. The same voltage difference (between "E" and "F") was also measured for the two subsequent sheets of 16 pound paper (indicated by reference numerals 237 and 238). Accordingly, the method can be used to reliably detect a difference in sheet weight (indicative of sheet thickness) for sheet media. This information can be used, for example, to control fusing parameters, as will be described more fully below.

Figure 3D:
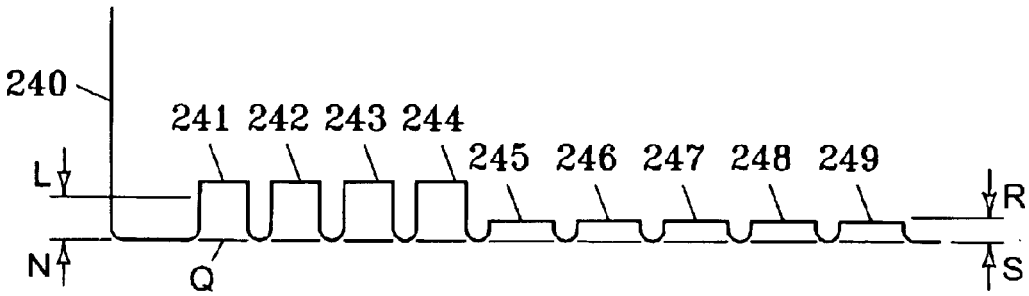

FIG. 3D represents a reproduction of oscilloscope trace 240 showing the effect when nine sheets of media were passed between the same sheet receiving components as used in the examples of FIGS. 3A through 3C. In the example shown in FIG. 3D, the first four sheets of media (indicated by numerals 241 through 244) were "Z"-fold envelopes, and the last four sheets of media (indicated by numerals 245 through 249) were "16 pound" paper. As can be seen, a quiescent voltage "Q" was applied across the sheet receiving components, and the first envelope (indicated by reference numeral 241) was passed between, and in contact with, the two sheet receiving components. A voltage difference, indicated by the distance between arrows "L" and "N" was measured for the first envelope. Three subsequent, essentially identical envelopes were then passed through the two sheet receiving components, and the same voltage difference, indicated by the arrows "L" and "N", was measured. However, when the first sheet of 16 pound paper passed between the sheet receiving components (indicated by reference numeral 245), a different, lesser voltage difference (indicated by the distance between arrows "R" and "S") was measured. The same voltage difference (between "R" and "S") was also measured for the three subsequent sheets of 16 pound paper (indicated by reference numerals 246 through 249). It will be noted that the results of the example shown in FIG. 3D are quite similar to the results of the example shown in FIG. 3C.

Similar results to those shown in FIGS. 3A through 3D can be observed for different types of sheet media (e.g., paper versus plastic transparencies), different grades of the same type of media (e.g., bond paper versus glossy photographic-grade paper), different widths of the same type of sheet media, and so on.

As can be seen by comparing the results obtained in the example shown in FIG. 3C to the results obtained in the example shown in FIG. 3D, merely measuring the voltage difference for two different sheets of media does not always provide absolute knowledge as to the sheet media. For example, the envelope indicated by reference numeral 241 in FIG. 3D produced a result remarkably similar to the result produced by the sheet of 20 pound paper indicated by reference numeral 231 in FIG. 3C. In some instances this will not matter. For example, in a fusing process the voltage difference alone produced by any sheet of media can be indicative of how the fusing process might be adjusted. That is, any increase in the voltage difference can indicate that the temperature of the heated fusing roller should be increased proportionally. In other applications it can be desirable to complement the voltage difference measurement with additional knowledge. For example, if the same type of sheet media is being provided to the fuser rollers 102 and 104 in FIG. 2, then a change in measured voltage difference is indicative of a change in moisture content in the paper (as in FIG. 3A), and a first adjustment to the fusing temperature can be made to account for this change can be performed. However, if the fusing section is used in an imaging apparatus having two paper supply trays (such as trays 12A and 12B of FIG. 1). and if the imaging apparatus has been previously configured to contain paper of different types of paper in the two trays (e.g., 24 pound paper in tray 12A, and 20 pound paper in tray 12B), then the processor 32 will be able to determine which tray the paper is being drawn from. In this instance the processor 30 can use this "sheet knowledge" to determine that a change in the measured voltage difference is due to a change in sheet thickness (and not due to a change in moisture content), and can then apply a second, different adjustment to the fusing temperature.

Figure 4:
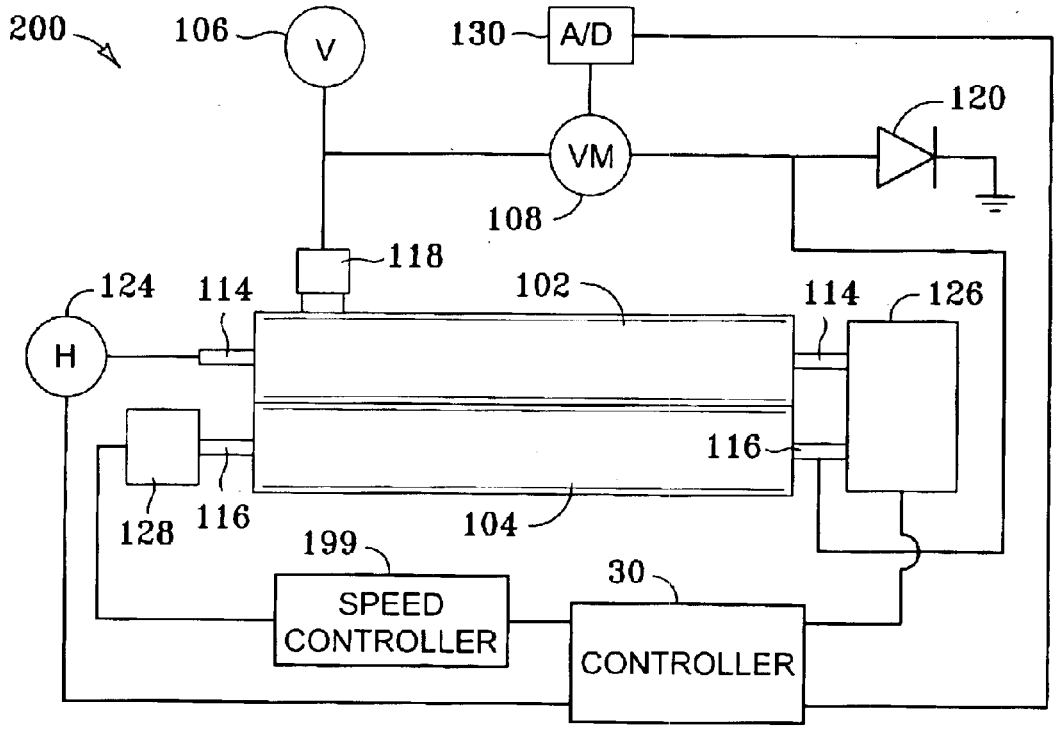
FIG. 4 is a front view depicting two fuser rollers and electrical circuitry that can be used in accordance with another embodiment of the invention.

As previously discussed, the information obtained by measuring the voltage difference when sheet media is passed between two sheet receiving components (such as fuser rollers 102 and 104 of FIG. 2). as well as a change in the measured voltage difference (e.g., as indicated in FIG. 3A), can be used for a variety of different purposes. In one example, the voltage difference measurement can be used in an apparatus for controlling a fuser in an imaging apparatus. An example of one such apparatus is depicted in FIG. 4, which is a front view depicting selected components from a fusing section 200 and components that can be used to control the fusing section. The fuser 200 includes like-numbered components as were described above with respect to FIG. 2. including first and second fuser rollers 102 and 104, voltage supply source 106, and voltage difference measuring device 108. The voltage difference measuring device 108 is configured to measure a difference in the electrical voltage across the first and second fuser rollers 102, 104 when sheet media is received between the rollers, and to generate a voltage difference signal in response thereto. The fuser 200 further includes the controller 30 of FIG. 1, which is configured to receive the voltage difference signal and to generate a fuser parameter control signal in response thereto. An analog-to-digital converter 130 can be used to convert the voltage difference signal from an analog form to a digital form so that it can more readily be used by the controller 30.

The fuser 200 of FIG. 4 can also include one or more fuser control devices which are responsive to the fuser parameter control signal. For example, the first fuser roller 102 can be provided with a heater (not shown, but discussed above with respect to the ceramic strip 110 of roller 102 of FIG. 2) configured to heat the first fuser roller. In this instance, the fuser control device can be a heat controller 124 which is configured to control heat input to the heater. (Other forms of fuser heaters include a halogen lamp placed within a hollow fuser roller, and an electrically resistant roller.) In another example wherein the first and second fuser rollers 102, 104 contact one another along a contact area and exert a pressure on one another along the contact area, the fuser control device can be a pressure controller 126 configured to adjust pressure between the first and second fuser rollers. For example, the fuser pressure controller can engage shafts 114 and 116 of respective fuser rollers 102 and 104, and can draw the shafts closer together to thereby increase pressure between the rollers, or push the shafts slightly apart to decrease the pressure between the rollers. In this instance, typically one of the rollers 102, 104 will be provided with a resilient coating to allow a greater range of pressure regulation while still maintaining contact between the rollers and the sheet media. In yet a further example, at least one of the first and second fuser rollers 102, 104 can be rotationally driven by a fuser drive unit, such as motor 128. In this instance the fuser control device can be a speed controller 199 configured to adjust the speed of the fuser drive unit 128. The speed controller 199 can be, for example, a variable power supply or a variable gear reduction unit.

Figure 5:
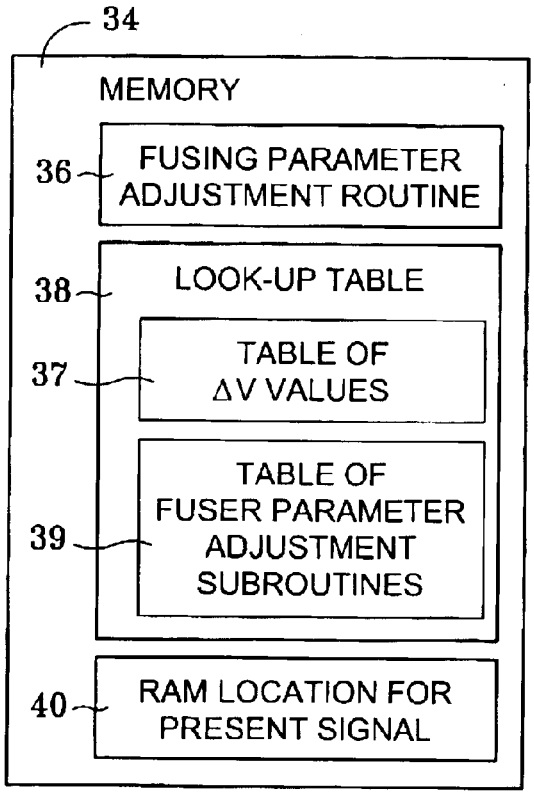
FIG. 5 is a diagram depicting components that can be stored in a computer readable memory device and used in methods and apparatus in accordance with embodiments of the invention.

The controller 30 of FIG. 3, which, as indicated previously, can be used to receive the voltage difference signal from the measuring device 108 and to generate a fuser parameter control signal in response thereto, can be arranged in several different configurations. As indicated in FIG. 1, the controller 30 can include a processor 32 and a computer-readable memory device 34 which can be read by the processor. Turning to FIG. 5, a diagram depicts components that can be stored in the computer readable memory device 34 and which can be used to allow the controller 30 to generate a fuser parameter control signal. The memory device 34 of FIG. 5 includes a RAM location 40 where the current voltage difference measurement from the measurement device (108, FIG. 4) can be stored. The memory device 34 can further include a "Fusing Parameter Adjustment Routine" 36 which is executable by the processor 32 (FIG. 1) to operate one or more fuser control devices (e.g., any of the fuser control devices 124, 126 and 199 described above with respect to FIG. 4) in accordance with a fuser parameter control signal. The memory device 34 further includes a look-up table 38, which is readable by the processor (32, FIG. 1) to allow the processor to generate the fuser parameter control signal. The look-up table 38 includes a table of voltage difference values 37, as well as a table of fuser parameter adjustment subroutines 39. An example of how the components depicted in FIG. 5 can be used to control a fusing process will be described below with respect to the flowchart 300 of FIG. 7.

Figure 6:
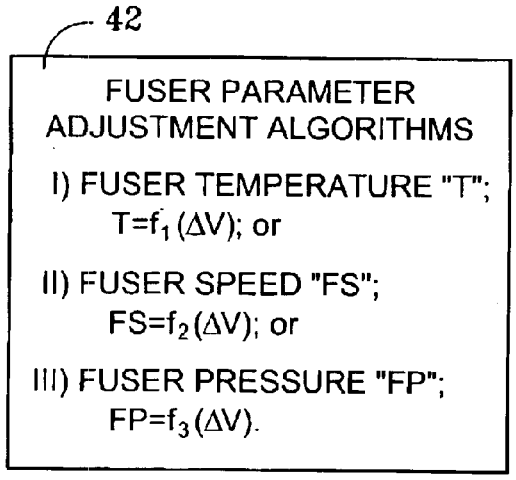
FIG. 6 is a diagram depicting fuser parameter adjustment algorithms that can be used in methods and apparatus in accordance with embodiments of the invention.

In one variation, rather than including a look-up table 38, the memory device 34 can include one or more "Fuser Parameter Adjustment Algorithms" 42, as depicted in FIG. 6, which are executable by the processor (30, FIG. 1) to generate the fuser parameter control signal. For example, one fuser parameter adjustment algorithm can control the fuser temperature (via temperature controller 124 of FIG. 4, for example) by calculating the fuser temperature "T" as a first function "$f_1$" of the voltage difference ("ΔV") measurement stored in the RAM location 40 of FIG. 5. In another example, the fuser parameter adjustment algorithm can control the fuser speed "FS" (via speed controller 199 of FIG. 4, for example) by calculating the fuser speed as a second function "$f_2$" of the voltage difference measurement stored in the RAM location 40 of FIG. 5. In yet a further example, the fuser parameter adjustment algorithm can control the fuser pressure "FP" (via pressure controller 126 of FIG. 4, for example) by calculating the fuser pressure as a third function "$f_3$" of the voltage difference measurement stored in the RAM location 40 of FIG. 5. It will be appreciated that in each example the actual fuser parameter (temperature, speed and pressure) does not need to be calculated using the respective fuser parameter adjustment algorithm, but rather a value (such as electric current applied to the fuser heater, or voltage applied to the motor 128 or the pressure controller 126) can be calculated. An example of how the components depicted in FIG. 6 can be used to control a fusing process will be described below with respect to the flowchart 400 of FIG. 8.

Figure 7:
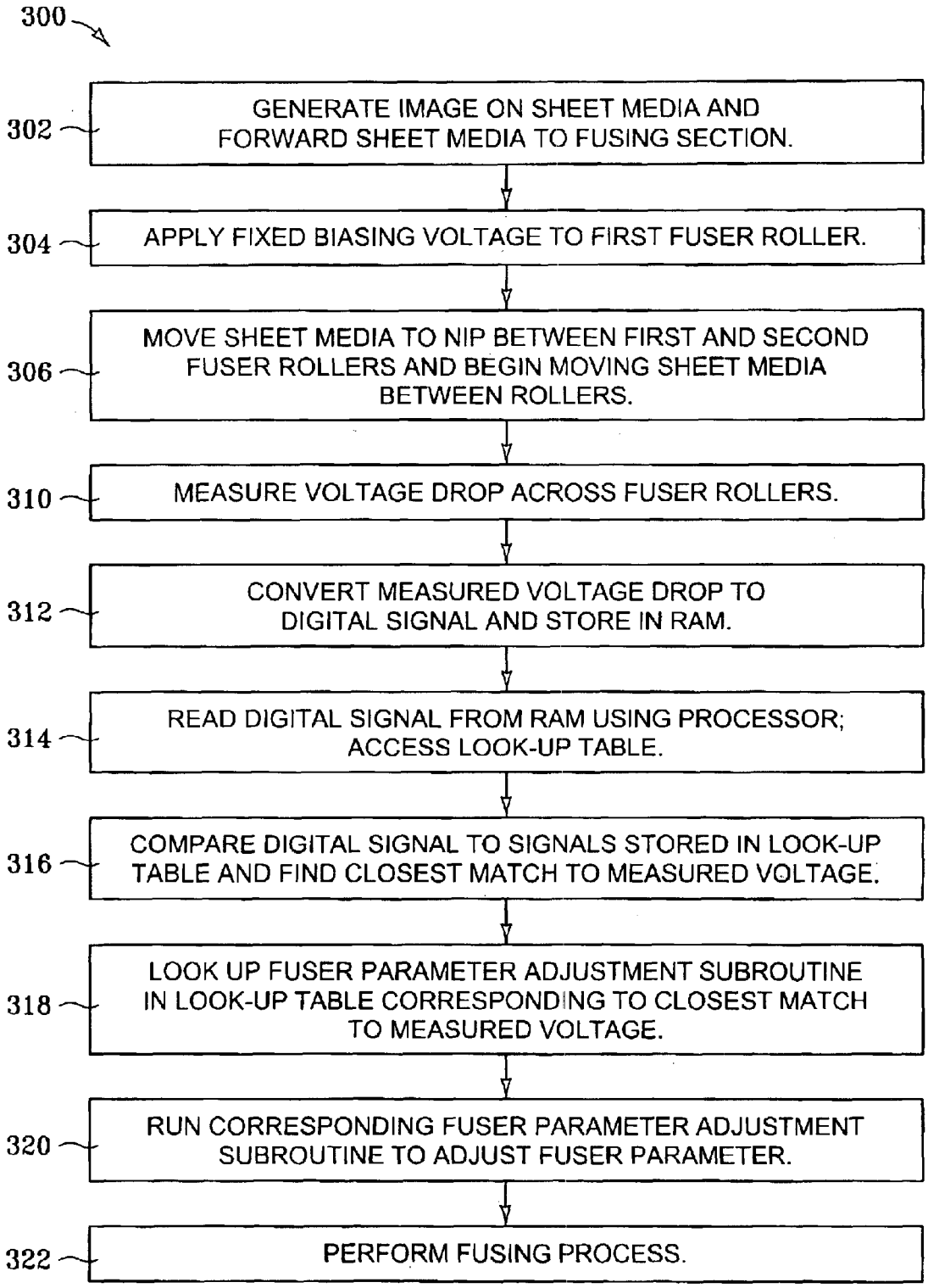
FIG. 7 is a flowchart depicting an exemplary method in accordance with a further embodiment of the invention.

Turning now to FIG. 7, a flowchart 300 depicts exemplary steps that can be performed by the system depicted in FIGS. 4 and 5 to control a fuser parameter. At step 302 of the flowchart 300 an image is generated onto a sheet of sheet media (as for example, by the image forming section 18 of FIG. 1), and the sheet is forwarded to the fusing section (such as fuser 200 of FIG. 4). At step 304, a preselected biasing voltage (e.g., −600 volts) is applied to the first fuser roller. This can be accomplished as depicted in FIG. 4 by the voltage supply source 106 being applied to roller 102. At step 306 the sheet media is moved into the nip (e.g., nip 113, FIG. 2) between the fuser rollers (e.g., rollers 102 and 104, FIG. 2), and the sheet begins moving between the rollers. At step 310 the voltage drop across the fuser rollers is measured (which can be done using the voltage difference measuring device 108 of FIG. 4), and at step 312 the measured voltage difference (or voltage drop) is converted from an analog signal to a digital signal (such as by the A/D converter 130 of FIG. 4), and the digital signal is stored in RAM (e.g., RAM location 40 of FIG. 5). At step 314 the processor (32, FIG. 1) reads the digital signal stored in RAM, and accesses the look-up table (38, FIG. 5). Specifically, as indicated at step 316, the processor (32, FIG. 1) accesses the table of voltage difference measurements (37, FIG. 5) and identifies the value in the voltage difference table which most nearly matches the actual (digitized) voltage drop measurement stored in RAM (40, FIG. 5). Then, at step 318, the processor (32, FIG. 1) identifies a "Fuser Parameter Adjustment Subroutine" from the table of fuser parameter adjustment subroutines (39, FIG. 5) which corresponds to the identified voltage drop value. At step 320 the processor (32, FIG. 1) runs the selected "Fuser Parameter Adjustment Subroutine" (as the "Fuser Parameter Adjustment Subroutine" 36, FIG. 5) to cause the appropriate fuser control device (e.g., control device 124, 126 or 199 of FIG. 5) to adjust the fuser parameter in accordance with the measured voltage drop for the specific sheet currently between the fuser rollers (e.g., rollers 102, 104, FIG. 4). The fusing process for that specific sheet is then performed at step 322.

Figure 8:
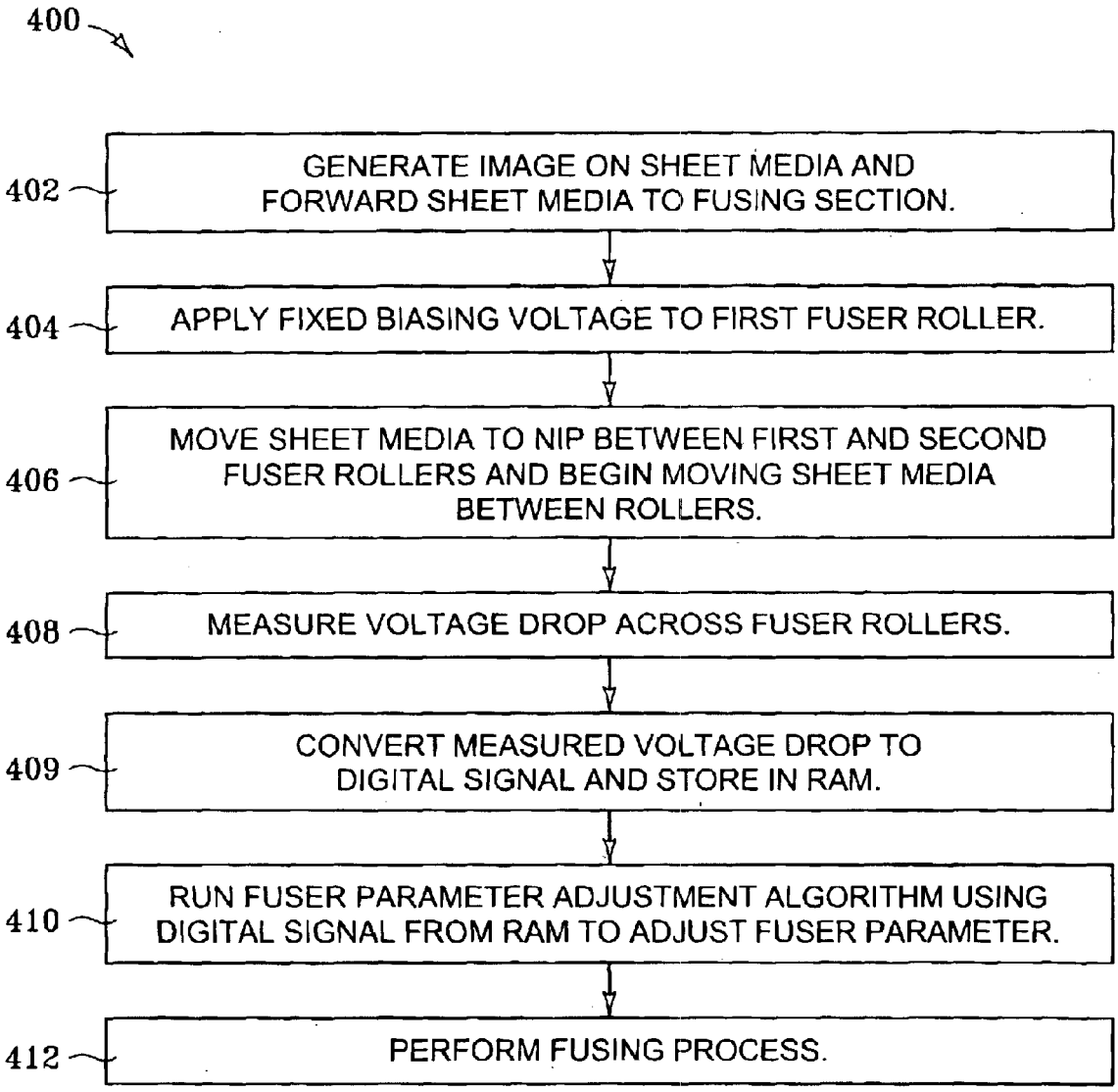
FIG. 8 is a flowchart depicting another exemplary method in accordance with yet another embodiment of the invention.

Turning to FIG. 8 a flowchart 400 depicts exemplary steps that can be performed by the system depicted in FIGS. 4 and 5 to control a fuser parameter, wherein the look-up table 38 of FIG. 5 is replaced with the "Fuser Parameter Adjustment Algorithms" 42 of FIG. 6. Step 402, 404, 406, 408 and 409 of the flowchart 400 correspond to respective steps 302, 304, 306, 310 and 312 of the flowchart 300 of FIG. 7, which were described above, and therefore do not need to be described again. At step 410 of the flowchart 400 the processor (32, FIG. 1) runs one or more of the "Fuser Parameter Adjustment Algorithms" (42, FIG. 6), using the (digitized) voltage measurement stored in RAM (40, FIG. 5) to generate a control value. The resulting control value is then used at step 320 by the "Fusing Parameter Adjustment Routine" (36, FIG. 5) to cause the appropriate fuser control device (e.g., control devices 124, 126 or 199 of FIG. 5) to adjust the fuser parameter in accordance with the measured voltage difference for the specific sheet of media currently between the fuser rollers (e.g., rollers 102, 104, FIG. 4). The fusing process for that specific sheet is then performed at step 412.

It will be appreciated that the steps depicted in flowcharts 300 and 400 of respective FIGS. 7 and 8 are exemplary only, and that additional, different or fewer steps can be used. For example, if during setup of an imaging apparatus a user designates certain types of sheet media as originating from certain paper trays (e.g., envelopes from tray 12A of FIG. 1, and letter size paper from tray 12B), then a separate look-up table (table 38 of FIG. 5) can be provided for each type of sheet media. In this case the processor (32, FIG. 1) will know the tray from which the media is drawn, and will be able to use the appropriate look-up table. Similarly, separate "Fuser Parameter Adjustment Algorithms" (42, FIG. 6) can be provided for each type of sheet media. In this way sheet media knowledge can supplement the voltage difference measurement signal in controlling the fusing process. Although flowcharts 300 and 400 are directed towards controlling one or more parameters related to a fusing process, similar approaches can be used to control other processes performed on the sheet media. For example, if the image forming section 18 of FIG. 1 is provided with a "Transfer Voltage Controller" 19, then the voltage used to transfer toner to the sheet media can be the controlled parameter.

It will also be appreciated that a controller having a processor (such as processor 32 of FIG. 1) is not required to control a parameter related to processing of the sheet media. For example, the controller can be a transistor, and the signal from the voltage difference measuring device 108 of FIG. 4 can be used as the current provided to the base of the transistor to control current flow from the emitter of the transistor. This controlled current can be used, for example, as electric current provided to the fuser heater. Other circuits (e.g., state circuits using state devices) can also be used as the controller without the use of a microprocessor.

As will be appreciated by viewing FIGS. 1 and 4 in conjunction, another embodiment of the present invention provides for an imaging apparatus 10 which includes an image forming section 18 and a fuser section (e.g., fusing section 200 of FIG. 4, which can replace fusing section 100 of FIG. 1). The fuser section includes first and second fuser components 102, 104 positioned relative to one another to form a sheet path therebetween. Although the "fuser components" 102, 104 are depicted as being rotating cylinders or rollers, this is not a requirement, and one of both of the fuser components can be stationary, and can be in a shape other than cylindrical. Generally, the fuser components are configured to each contact a sheet of media moving between the fuser components. The imaging apparatus 10 further includes a parameter control device (e.g., devices 18 (FIG. 1), 124 (FIG. 4), 126 (FIG. 4), and/or 199 (FIG. 4)) which is configured to receive a control signal and to use the control signal to control an operational parameter of the imaging apparatus. The imaging apparatus 10 also has a plurality of sheet media paths (16A, 16B, 20 and 22, FIG. 1) configured to facilitate movement of sheet media through the image forming section 18 and the fuser section (200, FIG. 4). An electrical voltage source (106, FIGS. 1 and 4) is configured to apply a biasing voltage across the first and second fuser components 102, 104. A voltage difference measuring device (108, FIGS. 1 and 4) is configured to measure a difference in the electrical voltage across the first and second fuser components 102, 104, and to generate a voltage difference signal in response thereto. The imaging apparatus 10 can further include a controller (30, FIGS. 1 and 4) configured to use the voltage difference signal to generate the control signal. The controller 30 can include a processor (32, FIG. 1) and a computer readable memory device (34, FIGS. 1 and 6) which can be read by the processor. The memory device 34 can further include a parameter adjustment algorithm (similar to the "Fuser Parameter Adjustment Algorithms" 42 of FIG. 6) which can be executed by the processor (32, FIG. 1) to generate the control signal.

In one variation the image forming section 18 of the imaging apparatus 10 of FIG. 1 can include a transfer toner transfer device (such as a corona discharge element, or a charged roller, not shown in the figures, but known in the art) configured to generate a transfer voltage to facilitate transfer of a toner to the sheet media. In this instance the parameter control device can be the transfer voltage controller 19. In another variation, the sheet media paths 16A, 16B, 20 and 22 can include sheet moving devices (e.g., powered rollers 17) configured to move sheet media along the sheet media paths at a selected speed. In this latter variation the parameter control device can be a sheet moving device speed controller 28, which can, for example, control the speed of the motor 26 which drives the powered rollers 17.

Examples have been described above of measuring a voltage difference imposed by a sheet of media placed between two sheet receiving components (e.g., fuser rollers 102 and 104 of FIG. 4) and using the measured voltage difference to control parameters in an imaging apparatus (10, FIG. 1) and a fuser (200, FIG. 4). Since the voltage difference measurement is indicative of characteristics of sheet media placed between the two sheet receiving components, it will be appreciated that use of the voltage difference measurement is not limited to the specific applications previously described, and that other uses of the voltage difference measurement can be employed. Accordingly, another embodiment of the invention provides for an apparatus for determining a characteristic of sheet media. The apparatus includes first and second sheet receiving components positioned relative to one another to form a sheet path therebetween. Fuser rollers 102 and 104 of FIG. 4 provide one non-limiting example of the respective first and second sheet receiving components. In general, the sheet receiving components are configured to each contact a sheet of media moving between the sheet receiving components. The apparatus further includes an electrical voltage source (one non-limiting example of which is voltage source 106 of FIG. 4) configured to apply a voltage across the first and second sheet receiving components (similar to the manner depicted in FIG. 4 wherein the voltage source 106 is applied across fuser rollers 102 and 104). The apparatus also has a voltage difference measuring means configured to measure voltage across the first and second sheet receiving components when sheet media is received between the first and second sheet receiving components, and to generate a voltage difference measurement signal in response thereto. One non-limiting example of a voltage difference measuring means is the voltage difference measuring device 108 of FIG. 4. The apparatus can also be provided with a processor (such as processor 32 of FIG. 1) configured to use the voltage difference measurement signal to generate sheet characteristic information. Examples of sheet characteristic information include moisture content, media type, media thickness, media width, etc. The sheet characteristic information can then be used for any appropriate purpose.

From the foregoing it will be appreciated that another embodiment of the invention provides for a method of controlling a fuser (such as exemplary fuser 200 of FIG. 4) in an imaging apparatus (such as exemplary imaging apparatus 10 of FIG. 1). The method includes the acts of providing a first fuser roller (e.g., fuser roller 102 of FIG. 4) and a second fuser roller (e.g., fuser roller 104 of FIG. 4) in parallel contact. A preselected voltage is applied across the first and second fuser rollers (such, for example, as by voltage supply source 106 of FIG. 4). In one example, the preselected voltage can be a biasing voltage selected to repel electrostatic particles from the first fuser roller. The biasing voltage can be, for example, an alternating voltage with a direct current bias. A sheet of sheet media is placed between the first and second fuser rollers, and, with the voltage applied across the fuser rollers, a change in the voltage across the fuser rollers is then measured (as for example by using the voltage difference measuring device 108 of FIG. 4). The measured change in the voltage is then used to control a fuser parameter.

Non-limiting examples of fuser parameters that can be controlled using the method just described include fuser temperature, fuser speed (i.e., the rate at which the sheet media is moved through the fuser rollers), and fuser pressure (i.e., the pressure exerted on sheet media by the fuser rollers). That is, in one example the method can further include providing a quantity of heat to the first fuser roller (such as by using the heated ceramic strip 110 of FIG. 2), and in this case the fuser parameter is the quantity of heat provided to the first fuser roller. In another example the method can further include rotating the first and second fuser rollers at a rotational speed (such as by using motor 128 of FIG. 4, for example), and in this example the fuser parameter is the rotational speed. In yet another example the method can further include applying pressure to the first and second fuser rollers where the rollers are in contact (such as, for example, by using the fuser roller pressure controller 126 of FIG. 4), and in this case the fuser parameter is the pressure applied to the first and second fuser rollers where the rollers are in contact.

In the method described above the act of using the measured change in the voltage across the fuser rollers to control the fuser parameter can include using the measured change in the voltage to generate a fuser parameter control signal. The fuser parameter control signal can then be used to control the fuser parameter. One example of this was described above with respect to the flowchart 300 of FIG. 8. In that example the measured change in the voltage (stored in RAM 40 of FIG. 5) was used by the "Fuser Parameter Adjustment Algorithms" (42, FIG. 6) to generate a control value that was then used by the "Fusing Parameter Adjustment Routine" (36, FIG. 5). In response, the "Fusing Parameter Adjustment Routine" produced a control signal that can be used by any of the fuser parameter control devices of FIG. 4 (e.g., devices 124, 126, and/or 199).

As was described above with respect to FIG. 2, although one method of the present invention can be practiced by applying a voltage across the fuser rollers, another method of the invention provides for controlling a fuser in an imaging apparatus by serially applying a preselected electrical current (such as by using current supply source 106A of FIG. 2) to: a first fuser roller; sheet media placed between the first fuser roller and a second fuser roller; the second fuser roller; and ground. Electrical current from the second fuser roller is measured (e.g., by using the ammeter 108A of FIG. 2), and the measured electrical current is then used to control a fuser parameter. The fuser parameters can be similar to those described above with respect to other methods of the invention.

A further embodiment of the present invention provides for a method of determining characteristics of sheet media. The method includes providing first and second electrically conductive rollers in parallel contact. A non-limiting example of such rollers is the fuser rollers 102 and 104 of FIG. 4, although non-fusing rollers can also be used. In one variation, rather than using rollers, a pair of sheet receiving components can be used, as discussed earlier. A preselected voltage is applied across the first and second rollers (which can be accomplished using the voltage supply source 106 of FIG. 4, by way of example), and sheet media is placed between the first and second rollers. A voltage difference is-then measured across the first and second rollers. One exemplary way of measuring the voltage difference is by using the voltage difference measuring device 108 of FIG. 4. The measured voltage difference is then used to determine characteristics of the sheet media. Non-limiting examples of how the voltage difference measurement can be used to determine characteristics of the sheet media were provided in the examples shown in FIGS. 3A through 3D. For example, in FIGS. 3A and 3B it is was demonstrated that the characteristic of moisture content in sheet media can be determined by a change in the voltage difference measurement. More specifically, the sheet media used in the example shown in FIG. 3A produced a first voltage difference, and the sheet media used in the example shown in FIG. 3B produced a second voltage difference greater than the first voltage difference. The sheet media used in the example shown in FIG. 3B had a 2% higher moisture content than the sheet media used in the example shown in FIG. 3A. Therefore, the voltage difference measurements in these two examples were used to determine the characteristic of moisture content of the sheet media, and more specifically, the difference in moisture content between the sheets used in each example.

As was described above with respect to FIGS. 5 and 7, this method can further include providing a look-up table (such as look-up table 38 of FIG. 5) correlating (either directly or indirectly) characteristics of sheet media to preselected voltage differences. The method can then include identifying a preselected voltage difference from the look-up table which most nearly corresponds to the measured voltage difference. (See, for example, step 316 of flowchart 300 of FIG. 7). In this case the method can then include selecting a characteristic of sheet media corresponding to the preselected voltage difference to thereby determine characteristics of the sheet media. For example, the look-up table can indicate that, for a specific sheet-media type (which can be determined from previously-provided sheet media knowledge, as discussed above), a specific voltage difference measurement can indicate a specific media moisture content. This information can then be used for any useful purpose, such as for controlling a process relating to imaging the sheet, sorting the sheet, etc. The method can further include acquiring sheet media knowledge of the sheet media, and using the sheet media knowledge to facilitate identifying the preselected voltage difference from the look-up table. This latter variation was described above with respect to variations on the flowchart 300 of FIG. 7, wherein it was stated that sheet media knowledge can be provided by a user (e.g., through the user interface 50 of the imaging apparatus 10 of FIG. 1), or it can be determined by a processor (e.g., processor 32 of FIG. 1) that can determine the origin or source of the media, and thus the media type (e.g., whether media is drawn from tray 12A or tray 12B of imaging apparatus 10 of FIG. 1). When sheet media knowledge can be obtained, then a separate look-up table for each determinable type of sheet media can be provided.

In another variation on the method consistent with FIGS. 6 and 8, rather than providing a look-up table to cross-reference the measured voltage difference, the method can further include providing a sheet media characteristic algorithm which uses the measured voltage difference to determine characteristics of the sheet media. One non-limiting example of a sheet media characteristic algorithm is the "Fuser Parameter Adjustment Algorithm" 42 of FIG. 6, the application of which was exemplarily described in the flowchart 400 of FIG. 8. In this instance the sheet media characteristic algorithm can determine that a particular sheet of media has a particular characteristic (e.g., moisture content, thickness, width, materials of construction, surface roughness, etc.) that distinguishes it from another sheet of media. Consequently, a different process can be applied to the particular sheet of media being considered versus another sheet of media. As with the look-up table, the sheet media characteristic algorithm can be complemented by acquiring sheet media knowledge of the sheet media, in the manner described above. In this instance the sheet media characteristic algorithm can use sheet media knowledge to determine characteristics of the sheet media. For example, if sheet media knowledge can be acquired (in the manner indicated above), then a first sheet media characteristic algorithm can be applied for a first known sheet media property (e.g., "media width is a No. 10 envelope"), and a second sheet media characteristic algorithm can be applied for a second known sheet media property (e.g., "media width is letter-sized paper").

As mentioned previously, methods and apparatus in accordance with embodiment of the present invention can be used for quality control processes. In one non-limiting example, the electrical resistance of continuous sheet media (such as paper in a newspaper or periodical printing process) can be continuously monitored using methods and apparatus described herein. In this example, the electrical resistance of the sheet media can be continuously measured before the sheet media is printed. The electrical resistance measurement information can then be used to variably adjust a heating element to dry the sheet media to a uniform moisture content as the sheet media passes the heating element. After drying, the sheet media can then be imaged. Alternately, or in addition to, heating the sheet media, the sheet media can be cooled to control characteristics of the sheet media.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An apparatus for controlling a fuser in an imaging apparatus, comprising:

a first fuser roller and a second fuser roller in parallel, adjacent orientation and configured to receive sheet media therebetween;

an electrical voltage source applied across the first fuser roller and the second fuser roller;

a voltage difference measuring device configured to measure a difference in the electrical voltage across the first and second fuser rollers when sheet media is received between the first and second fuser rollers, and to generate a voltage difference signal in response thereto;

a controller configured to receive the voltage difference signal and to generate a fuser parameter control signal in response thereto; and a fuser control device responsive to the fuser parameter control signal.

2. The apparatus of claim 1, and wherein:

the first fuser roller comprises a heater configured to heat the first fuser roller; and the fuser control device is a heat controller configured to control heat input to the heater.

3. The apparatus of claim 1, and wherein:

the first and second fuser rollers contact one another along a contact area and exert a pressure on one another along the contact area; and the fuser control device is a pressure controller configured to adjust pressure between the first and second fuser rollers.

4. The apparatus of claim 1, and wherein:

at least one of the first and second fuser rollers are rotationally driven by a fuser drive unit; and the fuser control device is a speed controller configured to adjust speed of the fuser drive unit.

5. The apparatus of claim 1, and wherein the controller comprises:

a processor and a computer readable memory device which can be read by the processor; and a fuser parameter adjustment algorithm stored in the memory device and executable by the processor to generate the fuser parameter control signal.

6. The apparatus of claim 1, and wherein the controller comprises:

a processor and a computer readable memory device which can be read by the processor; and a look-up table stored in the memory device and readable by the processor to generate the fuser parameter control signal.

7. The apparatus of claim 1, and wherein the first fuser roller comprises a central core and a fuser film placed over the central core, and further wherein the electrical voltage source is configured to provide a biasing voltage selected to repel electrostatic particles from the fuser film.

8. The apparatus of claim 7, and wherein the voltage source is configured to provide the biasing voltage as an alternating voltage with a direct current bias.

9. The apparatus of claim 8, and wherein the voltage source is configured to provide the biasing voltage in the range of about −700 volts to about −500 volts.

10. A method of controlling a fuser in an imaging apparatus, comprising:

providing a first fuser roller and a second fuser roller in parallel contact;

applying a preselected voltage across the first and second fuser rollers;

placing a sheet of sheet media between the first and second fuser rollers;

measuring a change in the voltage across the first and second fuser rollers; and using the measured change in the voltage to control a fuser parameter.

11. The method of claim 10, and further comprising providing a quantity of heat to the first fuser roller, and wherein the fuser parameter is the quantity of heat provided to the first fuser roller.

12. The method of claim 10, and further comprising rotating the first and second fuser rollers at a rotational speed, and wherein the fuser parameter is the rotational speed.

13. The method of claim 10, and further comprising applying pressure to the first and second fuser rollers where the rollers contact, and wherein the fuser parameter is the pressure applied to the first and second fuser rollers where the rollers contact.

14. The method of claim 10, and wherein using the measured change in the voltage to control the fuser parameter comprises using the measured change in the voltage to generate a fuser parameter control signal, and using the fuser parameter control signal to control the fuser parameter.

15. The method of claim 10, and wherein the preselected voltage is a biasing voltage selected to repel electrostatic particles from the first fuser roller.

16. The method of claim 11, and wherein the biasing voltage is an alternating voltage with a direct current bias.

17. A method of controlling a fuser in an imaging apparatus, comprising:

providing a first fuser roller and a second fuser roller in parallel contact;

applying a preselected electrical current to the first fuser roller;

placing a sheet of sheet media between the first and second fuser rollers;

measuring electrical current from the second fuser roller; and using the measured electrical current to control a fuser parameter.

18. The method of claim 17, and wherein the fuser is configured to have heat applied to at least one of the fuser rollers, to have pressure applied between the first and second fuser rollers, and to have rotational speed applied to the fuser rollers, and wherein the fuser parameter is at least one of the heat applied to at least one of the fuser rollers, the pressure applied between the first and second fuser rollers or the rotational speed applied to the fuser rollers.

19. An imaging apparatus, comprising:

an image forming section;

a fuser section comprising first and second fuser components positioned relative to one another to form a sheet path therebetween;

a parameter control device configured to receive a control signal and to use the control signal to control an operational parameter of the imaging apparatus;

a plurality of sheet media paths configured to facilitate movement of sheet media through the image forming section and the fuser section;

an electrical voltage source configured to apply a biasing voltage across the first and second fuser components;

a voltage difference measuring device configured to measure a difference in the electrical voltage across the first and second fuser components, and to generate a voltage difference signal in response thereto; and a controller configured to use the voltage difference signal to generate the control signal.

20. The imaging apparatus of claim 19, and wherein the controller comprises:

a processor and a computer readable memory device which can be read by the processor; and a parameter adjustment algorithm stored in the memory device and executable by the processor to generate the control signal.

21. The imaging apparatus of claim 19, and wherein the image forming section comprises a transfer toner transfer device configured to generate a transfer voltage to facilitate transfer of a toner to the sheet media, and wherein the parameter control device comprises a transfer voltage controller.

22. The imaging apparatus of claim 19, and wherein the plurality of sheet media paths comprise sheet moving devices configured to move sheet media along the sheet media paths at a selected speed, and wherein the parameter control device comprises a sheet moving device speed controller.

23. A method of determining characteristics of sheet media, comprising:

providing first and second electrically conductive rollers in parallel contact;

applying a preselected voltage across the first and second rollers;

placing sheet media between the first and second rollers;

measuring voltage difference across the first and second rollers;

using the measured voltage difference to determine characteristics of the sheet media;

providing a look-up table correlating characteristics of sheet media to preselected voltage differences, identifying a preselected voltage difference from the look-up table which most nearly corresponds to the measured voltage difference; and selecting a characteristic of sheet media corresponding to the preselected voltage difference to thereby determine characteristics of the sheet media.

24. The method of claim 23, and further comprising acquiring sheet media knowledge of the sheet media, and using the sheet media knowledge to facilitate identifying the preselected voltage difference from the look-up table.

25. A method of determining characteristics of sheet media, comprising:

providing first and second electrically conductive rollers in parallel contact;

applying a preselected voltage across the first and second rollers;

placing sheet media between the first and second rollers;

measuring voltage difference across the first and second rollers; using the measured voltage difference to determine characteristics of the sheet media; and providing a sheet media characteristic algorithm which uses the measured voltage difference to determine characteristics of the sheet media.

26. The method of claim 25, and further comprising acquiring sheet media knowledge of the sheet media, and wherein the sheet media characteristic algorithm further uses sheet media knowledge to determine characteristics of the sheet media.

27. Apparatus for determining a characteristic of sheet media, comprising:

first and second sheet receiving components positioned relative to one another to form a sheet path therebetween;

an electrical voltage source configured to apply a voltage across the first and second sheet receiving components;

a voltage difference measuring means configured to measure voltage across the first and second sheet receiving components when sheet media is received between the first and second sheet receiving components, and to generate a voltage difference measurement signal in response thereto; and a processor configured to use the voltage difference measurement signal to generate sheet characteristic information in response thereto.

* * * * *